US007823622B2

(12) United States Patent
Yu

(10) Patent No.: US 7,823,622 B2
(45) Date of Patent: Nov. 2, 2010

(54) EJECTION AND STAMPING DEVICE

(75) Inventor: Jih-Lee Yu, Taoyuan Hsien (TW)

(73) Assignee: Chiu Ta Hydraulic Machine MFG. Co., Ltd., Taoyuan Hsien (TW)

( * ) Notice: Subject to any disclaimer, the term of this patent is extended or adjusted under 35 U.S.C. 154(b) by 356 days.

(21) Appl. No.: 12/141,926

(22) Filed: Jun. 19, 2008

(65) Prior Publication Data

US 2009/0314454 A1 Dec. 24, 2009

(51) Int. Cl.
*B22D 17/22* (2006.01)

(52) U.S. Cl. ..... 164/347

(58) Field of Classification Search ..... 164/312–314, 164/120, 319, 320, 76.1, 113, 131, 347; 29/527.4, 29/527.5

See application file for complete search history.

(56) References Cited

U.S. PATENT DOCUMENTS 4,844,146 A * 7/1989 Kikuchi ..... 164/155.4

* cited by examiner

*Primary Examiner*—Jessica L Ward
*Assistant Examiner*—Steven Ha
(74) *Attorney, Agent, or Firm*—Leong C. Lei

(57) ABSTRACT

An ejection and stamping device is arranged at one side of an upper die of a vertical die casting machine and include a base on which first and second pistons are arranged. The first piston is coupled to a stamping board, while the second piston is coupled to an ejection board. When a casting of a die casting process is not completely solidified, the first piston drives the stamping board to carry out a localized stamping operation of a portion of the casting and then the second piston is operated to drive the ejection board for ejecting out the casting. In this way, local density and strength of the casting are enhanced and the product quality of the casting is notably improved.

4 Claims, 8 Drawing Sheets

EJECTION AND STAMPING DEVICE

BACKGROUND OF THE INVENTION (a) Technical Field of the Invention

The present invention relates to an ejection and stamping device that is coupled to a vertical die-casting machine, and particularly to a device capable of carrying out stamping operation in a die casting process.

(b) Description of the Prior Art

Auto parts, ironware parts or electronic parts are often made by die casting or stamping. The die casting is carried out by pouring metal melt in a die or mold and a rough casting can be removed from the mold after the metal melt solidifies and shapes up. The rough casting often carries scrap or burring and pores on surfaces, and secondary machining is needed to for example remove the scrap or burring, polish the casting and form coatings. The stamping, on the other hand, is carried out with a die that forcibly strike a softened metal blank to shape the metal blank into a contour corresponding to the die. A stamped product has a smooth surface. These machining processes are different from each other.

Taking the die casting as an example, a regular process of the die casting is illustrated in FIG. 1, which includes the following steps:

Step 1: melt feeding (reference numeral 11), wherein a melt supplying device supplies heated and molten metal liquid into a gate of a lower die (example being given for a vertical die casting machine);

Step 2: mold closing (reference numeral 12), wherein a hydraulic mechanism drives an upper die downward to have the upper and lower dies mated and closing;

Step 3: shooting (reference numeral 13), wherein a hydraulic injection mechanism forces the metal liquid or melt within the gate into a mold cavity defined between the upper and lower dies;

Step 4: cooling (reference numeral 14), wherein the metal melt, after completely filled in the mold cavity, is cooled down to shape up;

Step 5: mold opening (reference numeral 15), wherein, after the metal melt is cooled down and shapes up, the hydraulic mechanism is operated again to drive the upper die upward thereby opening the upper and lower dies that were closed together; and Step 6: casting ejection (reference numeral 16), wherein, during the process of opening of the dies, the rough casting is moved with the upper die to a preset position and an ejection device that is arranged by the upper die is operated to drive an ejection board to eject the casting out of the upper die.

Referring to FIG. 2, which shows the structure of a conventional ejection device, taking the vertical die casting machine as an example again, the ejection device, which is broadly designated at 2, is arranged above the upper die and comprises a base 21, a piston cylinder 22, a piston 23, and an ejection board 24. The piston cylinder 22 is centrally mounted to the base 21. An end of the piston 23 is movably received in the piston cylinder 22 and an opposite end is coupled to the ejection board 24. Thus, when the hydraulic mechanism moves the upper die to the preset position for carrying out die opening, the piston 23 inside the piston cylinder 22 drives the ejection board 24 in an opposite direction to cause ejection pins 25 that are mounted to a surface of the ejection board 24 to penetrate through the mold cavity for ejecting out the casting that is within the mold cavity.

However, the casting that is obtained with the above described casting process still needs a secondary machining, which is very time-consuming and inefficient and also adds the manufacturing costs. In addition, the design of the ejection device 2 is plain and the operation of each stroke thereof is only producing a movement opposite to the hydraulic mechanism to eject the rough casting out of the mold cavity. Improving performance of casting is not likely. Thus, further improvement is desired to make perfect.

SUMMARY OF THE INVENTION

The primary purpose of the present invention is to provide an ejection and stamping device, which features both ejection and an operation of localized stamping so as to notably enhance the manufacturing efficiency and product quality.

To achieve the above objective, the present invention provides an ejection and stamping device, which is arranged at one side of an upper die of a vertical die casting machine and comprises a base, a first piston, a second piston, a stamping board, and an ejection board. The first and second pistons are arranged on opposite sides of the base and are respectively enclosed by upper and lower caps. The first and second pistons are arranged in a co-axial manner with the first piston coupled to the stamping board and the second piston coupled to the ejection board.

As such, the ejection and stamping device in accordance with the present invention is operated by a control device to sequentially drive the first and second pistons at a time point after a die casting operation is done while a rough casting does not completely solidify, whereby the first piston moves the stamping board to carry out a localized stamping operation on a portion of the casting and then the second piston moves the ejection board to eject out the localized-stamped casting. In this way, density of certain portions of the casting obtained from the die casting process can be substantially increased and the manufacturing efficiency and the product quality can also be notably enhanced.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
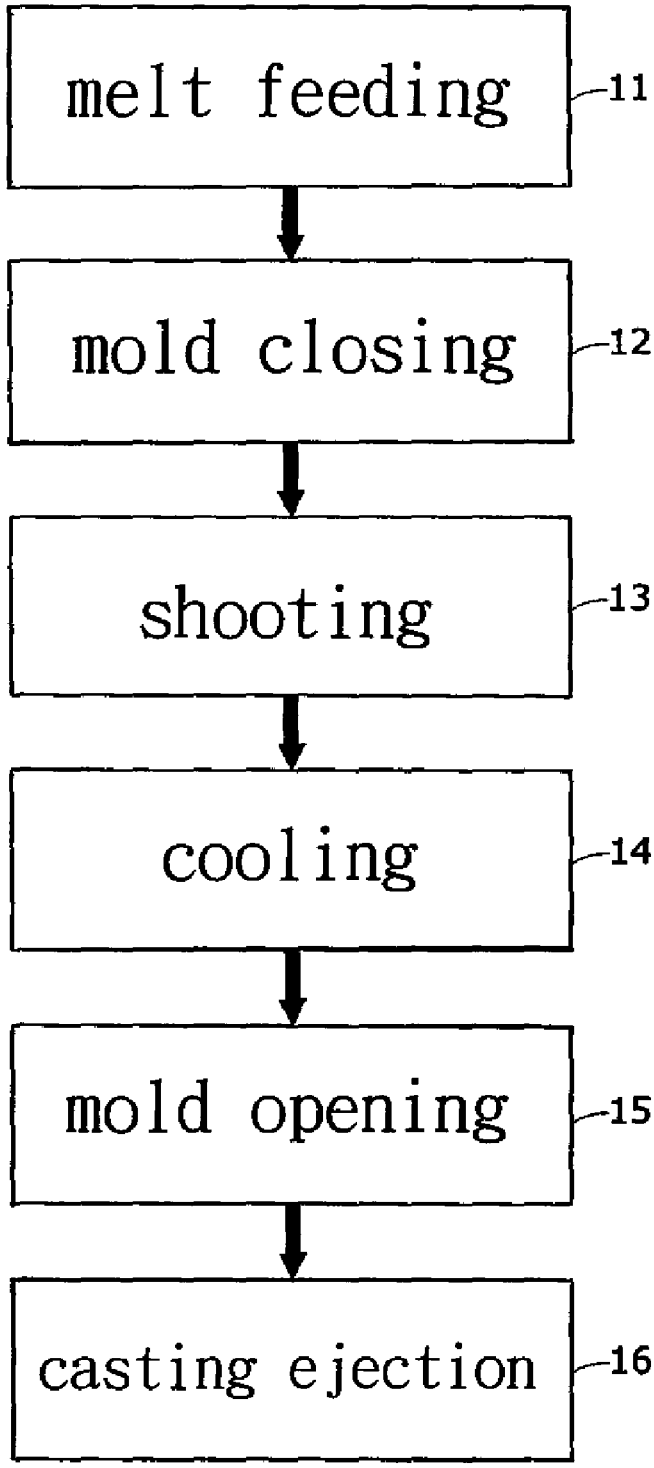
FIG. 1 is a flow chart illustrating a conventional die casting process.
Figure 2:
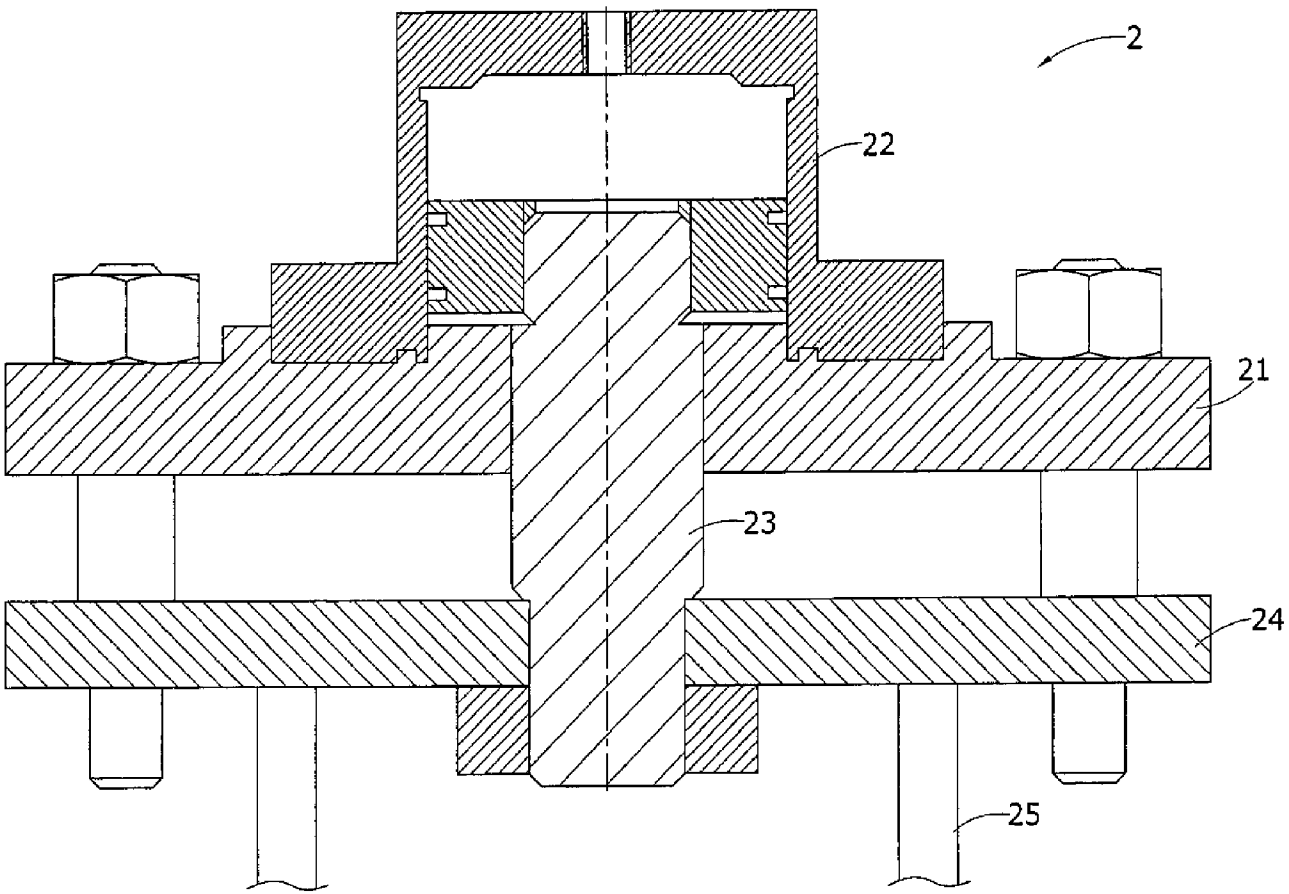
FIG. 2 is a cross-sectional view illustrating a conventional ejection device.
Figure 3:
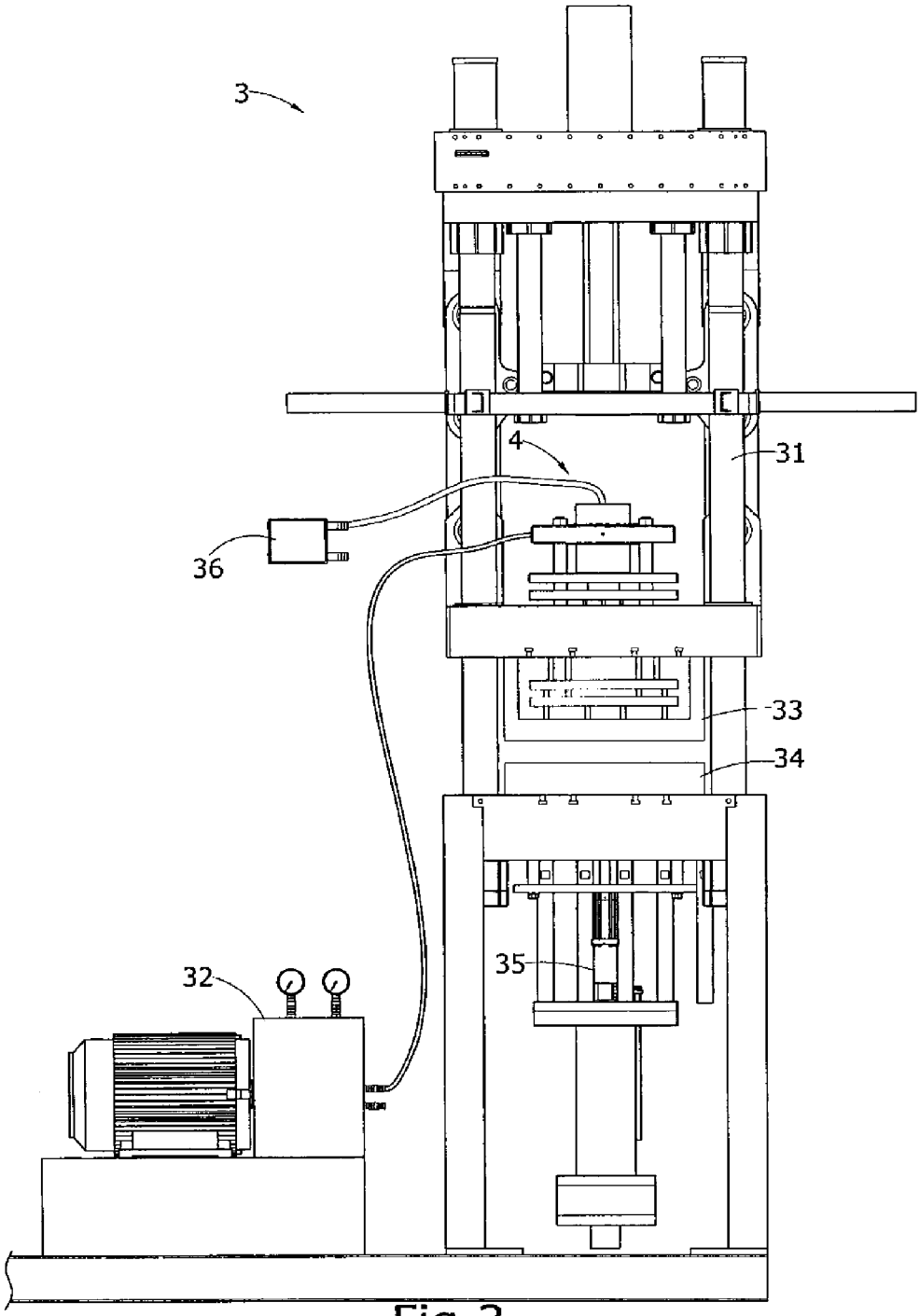
FIG. 3 is a side elevational view of a vertical die casting machine in which an ejection and stamping device constructed in accordance with the present invention is embodied.
Figure 4:
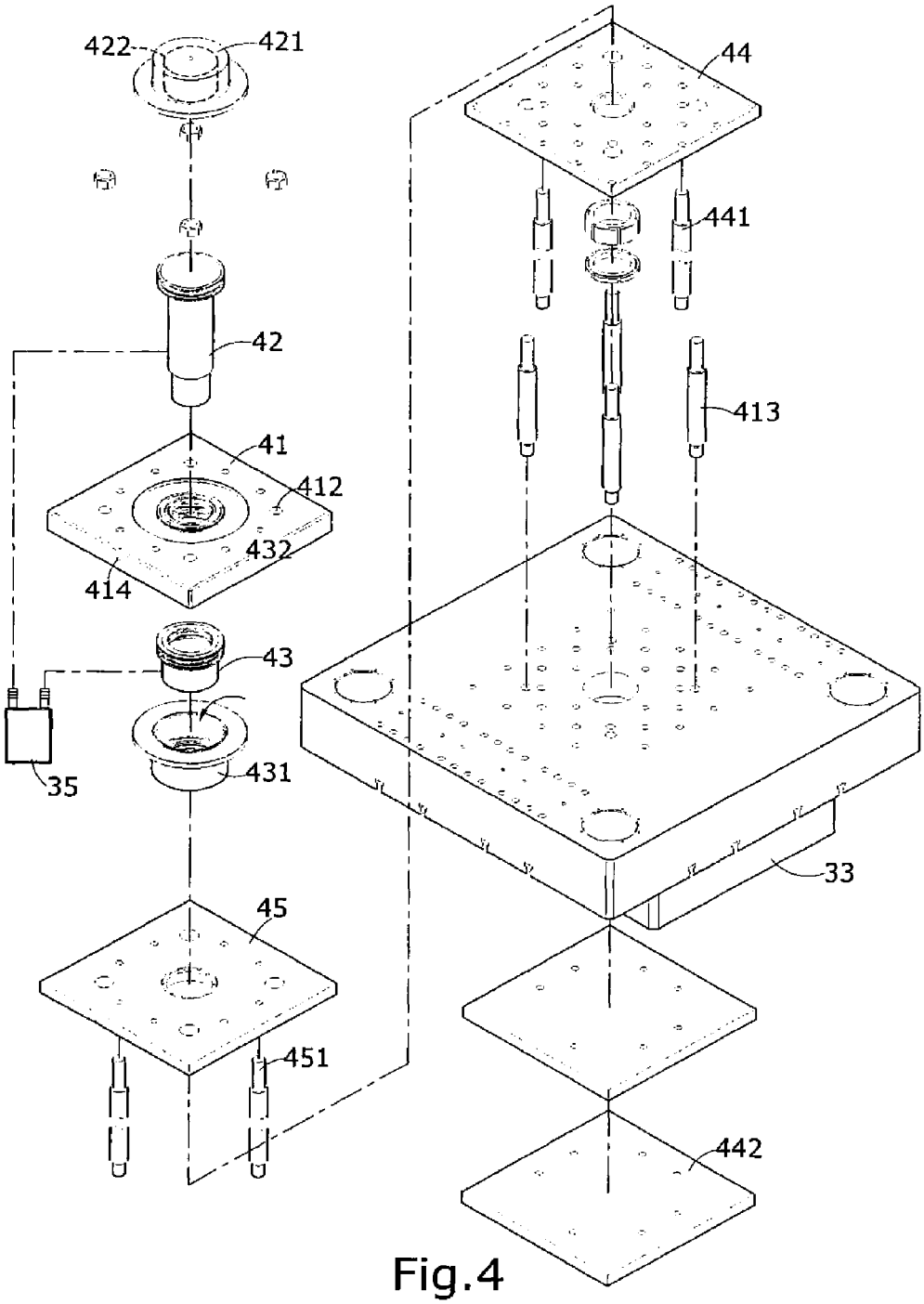
FIG. 4 is an exploded view of the ejection and stamping device of the present invention.
Figure 5:
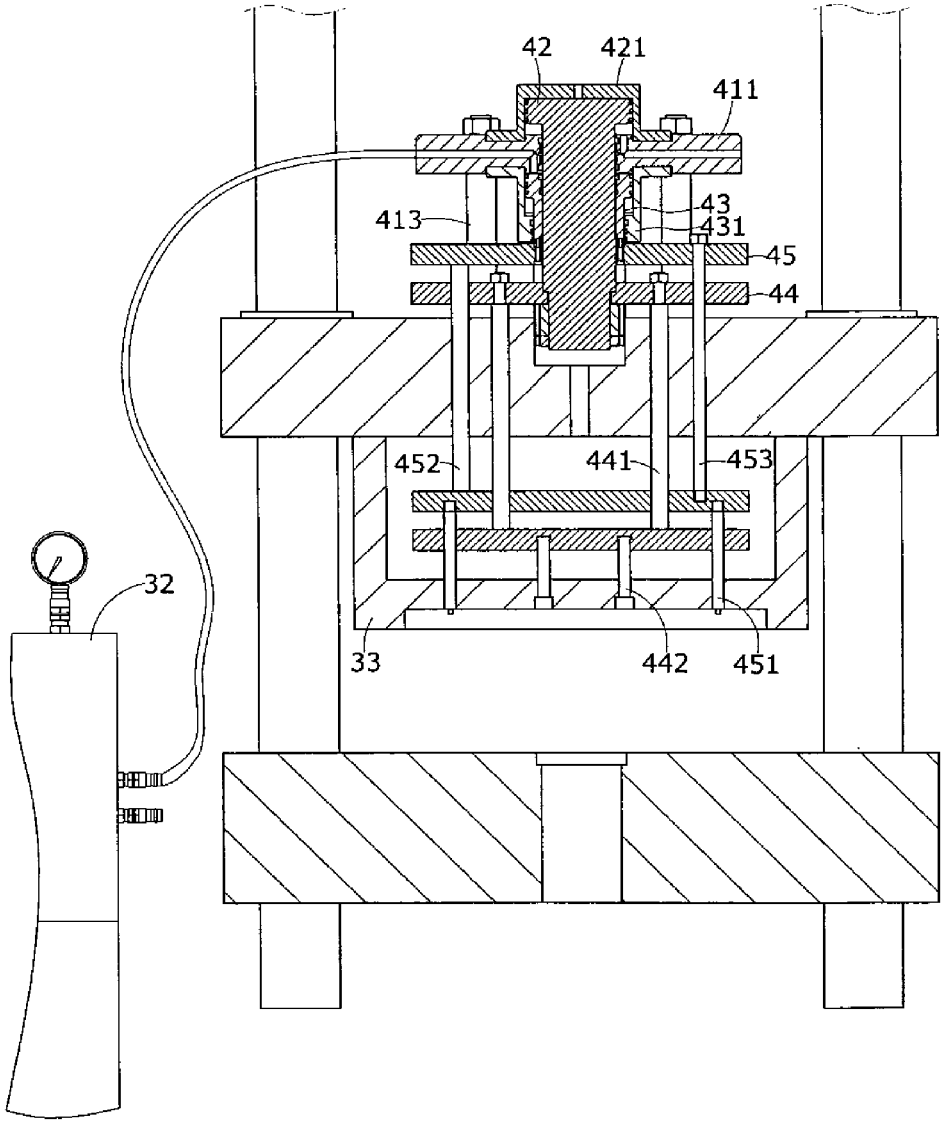
FIG. 5 is a cross-sectional view of the ejection and stamping device of the present invention.

With reference to the drawings and in particular to FIGS. 3-5, which respectively show a side elevational view of a vertical die casting machine in which an ejection and stamping device constructed in accordance with the present invention is embodied, an exploded view of the ejection and stamping device of the present invention, and a cross-sectional view of the ejection and stamping device of the present invention, a vertical die casting machine, which is generally designated at 3, comprises a chassis 31 in an upper portion thereof an upper die 33 is reciprocally and vertically movable by a hydraulic mechanism 32. A lower die 34 is arranged in the chassis 31 opposite to the upper die 33.

An ejection and stamping device constructed in accordance with the present invention, generally designated at 4, is arranged in the chassis 31 and above the upper die 33. The ejection and stamping device 4 comprises a base 41 which forms substantially in a central portion thereof a through hole 411 and a plurality of fixing holes 412 in a circumferential portion thereof for fixing atop a fixing board of the upper die 33 by means of a plurality of fixing bars 413. The base 41 forms a plurality of oil passages 414 therein.

A first piston 42 is arranged centrally in the base 41 by extending through the through hole 411 and is covered by an upper cap 421 to have the first piston 42 enclosed inside the upper cap 421, whereby a sealed space 422 is formed between the first piston 42 and the upper cap 421. The sealed space 422 is in communication with one oil passage 414 of the base 41. The first piston 42 is set in information communication with a control device 35, whereby the control device 35 drives the hydraulic mechanism 32 to cause reciprocal vertical movement of the first piston 42.

A second piston 43 is set coaxial with respect to the first piston 42 by being concentrically fit over an end portion of the first piston 42 that extends through the base 41 and is covered by a lower cap 431 so as to have the second piston 43 enclosed inside the lower cap 431. A sealed space 432 is formed between an upper end of the second piston 43 and the lower cap 431 and is in communication with another one of the oil passages 414 of the base 41. The second piston 43 is similarly in information communication with the control device 35 for effecting reciprocal and vertical movement of the second piston 43.

A stamping board 44 is coupled to the first piston 42. The stamping board 44 has a surface from which a plurality of stamping bars 441 extends to connect to a stamping die 442, which is arranged inside a mold cavity of the upper die 33.

An ejection board 45 is coupled to the second piston 43 and has a surface forming a plurality of ejection pins 451 extending into the mold cavity of the upper die 33. Further, the ejection board 45 is coupled to the second piston 43 by a plurality of ejection bars 452 and reversing bars 453 for synchronously and simultaneously moving the stamping board 44 and the ejection board 45 back to the original positions after completion of die casting operation.

Due to the slight construction modification of the present invention with respect to the conventional ejection device 2, the upper die 33 requires a space for accommodating the stamping die 442 for carrying out stamping operations. Once a die casting operation for making a cast product (rough casting) is completed, before the cast product completely solidifies, the control device 35 operates to sequentially drive the first piston 42 and the second piston 43, making the first piston 42 moving the stamping board 44 to carry out a localized stamping operation on the cast product, and then the second piston 43 moving the ejection board 45 to eject out the stamped cast product, whereby local density of a portion of the cast product is substantially increased and the product quality is also notably enhanced. In addition, the control device 35 can be operated in different ways, in which the operation sequence and timing of the first piston 42 and the second piston 43 are changed for realizing convenience and flexibility of operation.

Figure 6:
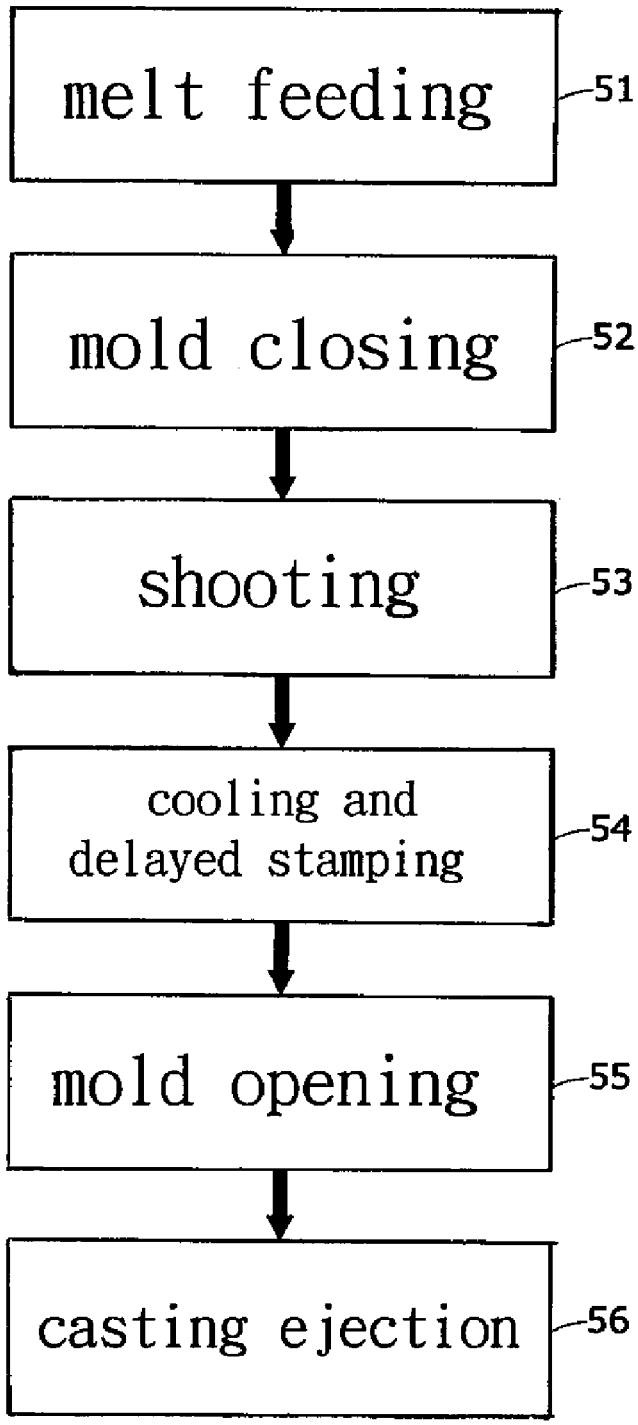
FIG. 6 is a flow chart illustrating an operation process carried out by the present invention.

Reference is now made to FIG. 6, which shows a flow chart for an operation carried out by the present invention. Reference is also made to FIG. 3 for a detailed description of the operation of the ejection and stamping device of the present invention, which includes the following steps:

Step 1: melt feeding (reference numeral 51), wherein a melt supplying device supplies heated and molten metal liquid (melt) into a gate of the lower die 34 (reference being had to a vertical die casting machine);

Step 2: mold closing (reference numeral 52), wherein the hydraulic mechanism 32 drives the upper die 33 to have the upper and lower dies 33, 34 mated and closing;

Step 3: shooting (reference numeral 53), wherein a hydraulic injection mechanism forces the metal liquid or melt within the gate into a mold cavity defined between the upper and lower dies 33, 34 and once the mold cavity gets full of the melt, the casting process is put in progress;

Step 4: cooling and delayed stamping (reference numeral 54), wherein the metal melt, after introduced into the mold, is gradually cooled down, and in accordance with the present invention, opening of the dies is delayed until the cast product (casting) gets semi-solidified, which means the cast product has already shaped up but maintains certain plasticity, and at that moment the control device initiates the operation of the ejection and stamping device 4 of the present invention, making the first piston 42 generate a force that drives the stamping bars 441 to move the stamping die 442 downward for carrying out a localized stamping operation on the semi-solidified casting;

Step 5: mold opening (reference numeral 55), wherein, after the cast product has been subjected to localized stamping and is cooled down, the stamping board 44 returns to the original position and the hydraulic mechanism 32 is operated again to drive the upper die 33 upward thereby opening the upper and lower dies 33, 34 that were closed together; and Step 6: casting ejection (reference numeral 56), wherein, after the dies are opened, the ejection and stamping device 4 arranged above the upper die 33 and an ejection device arranged below the ejection and stamping device 4 are operated to eject out the cast product, in which during the operation of the ejection and stamping device 4 of the present invention, the first piston 42 and the second piston 43 are moved in opposite directions to separate the stamping die 442 from the product, while the ejection pins 451 of the ejection board 45 eject out the product that is within the mold cavity of the upper die 33, the product within the mold cavity of the lower die 34 being ejected out by the ejection device.

Figure 7:
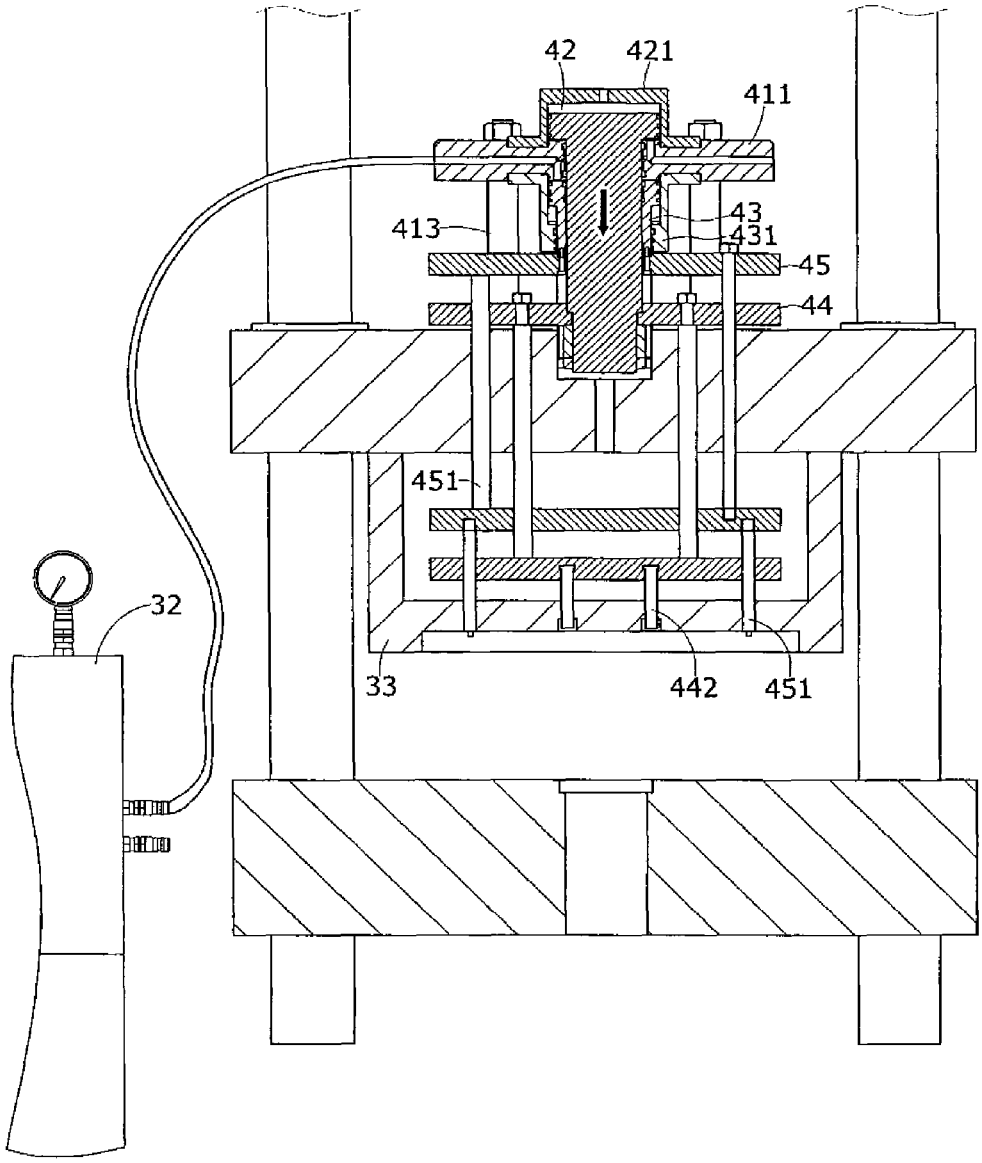
FIG. 7 is a schematic view demonstrating the operation of the present invention.
Figure 8:
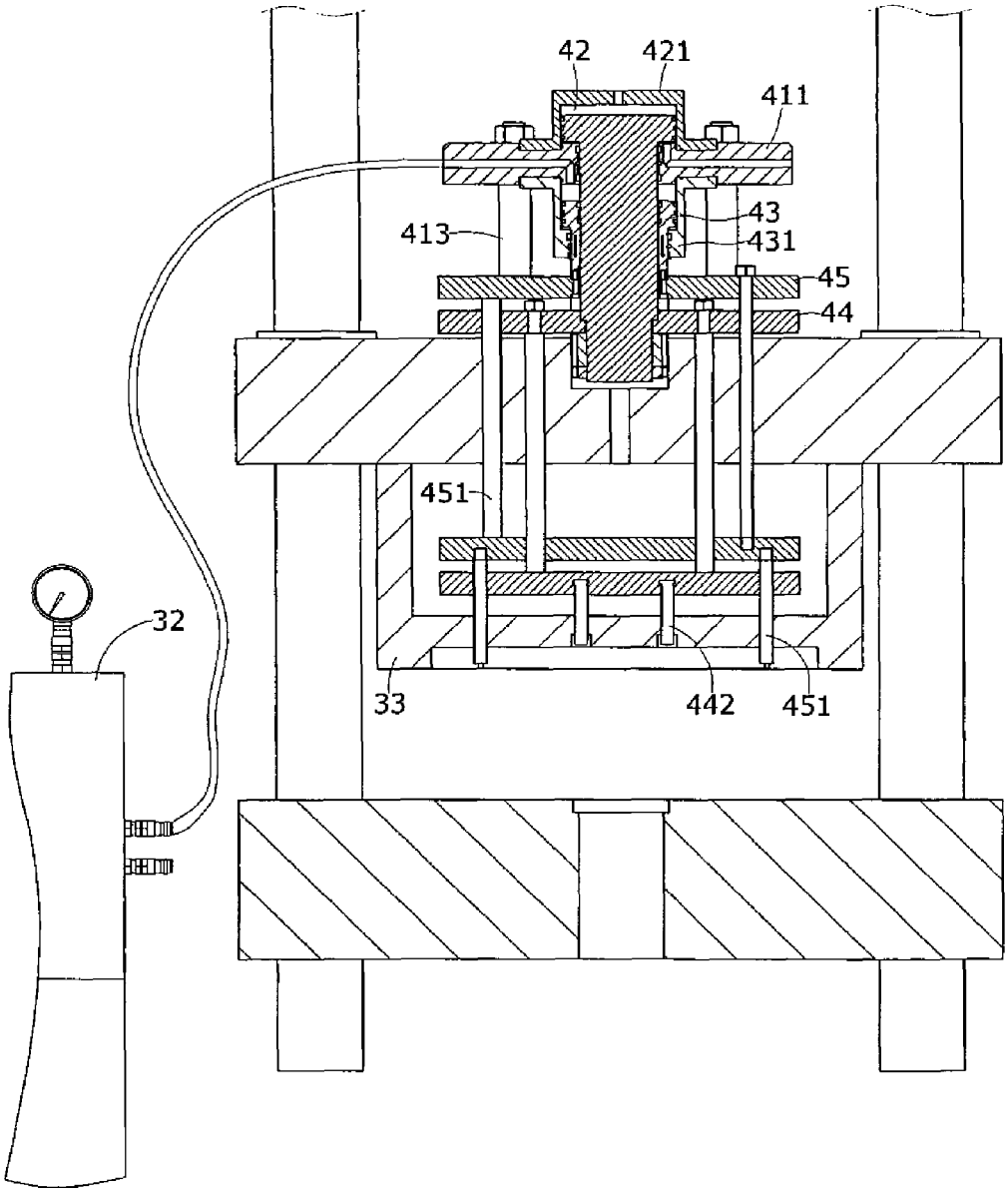
FIG. 8 is another schematic view demonstrating the operation of the present invention.

Referring to FIGS. 7 and 8, which demonstrates the operation of the present invention, when the ejection and stamping device 4 of the present invention carries out a stamping process, with the mold cavity in a closed condition and the metal in a semi-solidified condition, the hydraulic mechanism 32 introduces the hydraulic fluid or oil into the oil passage 414 associated with the first piston 42 to drive the first piston 42 downward and synchronously moves the stamping board 44 and the stamping die 442 downward. By means of the designed contour of the stamping die 442, the semi-solidified metal is stamped and thus shaped. The first piston 42 then follows pre-scheduled timing to move upward. In ejecting out the cast product, the second piston 43 is caused to move downward and synchronously moves the ejection board 45 and the ejection pins 451 downward to have the ejection pins 451 penetrating into the mold cavity to eject out the product. Once the ejection is completed, the first piston 42 is moved upward to return the stamping board 44 and the ejection board 45 back to the original positions.

As discussed above, the ejection and stamping device of the present invention provides the following advantages:

(1) As shown in FIG. 5, the ejection and stamping device 4 of the present invention uses the first piston 42 and the second piston 43 to respectively effect movement of the stamping board 44 and the ejection board 45 in a two-step manner thereby featuring both stamping operation and ejection, which certainly leads to increase of manufacturing efficiency and enhancement of product quality.

(2) The relationship between the stamping die 442 in accordance with the present invention and the original die are re-designed to allow for the addition of the device for carrying out localized stamping operation on the cast product without increasing the complication of the original operation.

(3) Further, the first piston 42 and the second piston 43 in accordance with the present invention are set in information communication with the control device 35 and this allows for the adjustment of the stamping timing and the sequence of ejection, leading to enhanced convenience of the operation. The above described in only an example embodiment of the present invention and it is apparent that modifications can be made to the above described structure without departing from the scope of the present invention. For example, the hydraulic mechanism can be replaced by a pneumatic mechanism and the upper and lower caps and the base can be combined together as an integrally formed cylinder.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An ejection and stamping device comprising:

a base, which forms substantially in a central portion thereof a through hole and a plurality of fixing holes in a circumferential portion thereof for fixing atop a fixing board of an upper die of a vertical die casting machine by means of a plurality of fixing bars, the base forming a plurality of oil passages therein;

a first piston, which is arranged centrally in the base, an upper cap being mounted to a top of the base to form a sealed space between the first piston and the upper cap, the sealed space being in communication with one oil passage;

a second piston, which is fit over an end portion of the first piston, a lower cap being mounted to an underside of the base to form another sealed space between the second piston and the lower cap, said another sealed space being in communication with another one of the oil passages;

a stamping board, which is coupled to the first piston and has a surface from which a plurality of connection bars extends to connect to a stamping die, which is arranged inside the upper die; and an ejection board, which is coupled to the second piston and has a surface forming a plurality of ejection pins extending into a mold cavity of the upper die.

2. The ejection and stamping device as claimed in claim 1, wherein the first piston and the second piston are set in information communication with a control device.

3. The ejection and stamping device as claimed in claim 1, wherein the oil passages are in communication with a hydraulic mechanism.

4. The ejection and stamping device as claimed in claim 1, wherein the ejection board is coupled to the second piston by a plurality of ejection bars and reversing bars.

* * * * *